US005469130A

United States Patent [19]

Okada et al.

[11] Patent Number: 5,469,130

[45] Date of Patent: Nov. 21, 1995

[54] HIGH FREQUENCY PARALLEL STRIP LINE CABLE COMPRISING CONNECTOR PART AND CONNECTOR PROVIDED ON SUBSTRATE FOR CONNECTING WITH CONNECTOR PART THEREOF

[75] Inventors: Takekazu Okada, Kameoka; Yuichi Maruyama, Nagaokakyo; Kazuya Sayanagi, Osaka, all of Japan

[73] Assignee: Murata Mfg. Co., Ltd., Japan

[21] Appl. No.: 158,945

[22] Filed: Nov. 29, 1993

[30] Foreign Application Priority Data

Nov. 27, 1992 [JP] Japan ..... 4-318510
May 14, 1993 [JP] Japan ..... 5-112723

[51] Int. Cl.[6] ..... H01P 1/04

[52] U.S. Cl. ..... 333/246; 333/260

[58] Field of Search ..... 333/33, 238, 246, 333/260

[56] References Cited

U.S. PATENT DOCUMENTS

| | | | |
|---|---|---|---|
| 2,721,312 | 10/1955 | Grieg et al. | 333/238 |
| 2,812,501 | 11/1957 | Sommers | 333/238 |
| 3,696,433 | 10/1972 | Killion et al. | 333/238 X |
| 4,110,712 | 8/1978 | Morris | 333/238 X |
| 4,626,805 | 12/1986 | Jones | 333/246 X |
| 4,631,505 | 12/1986 | Schiavone | 333/260 X |
| 4,870,375 | 9/1989 | Krueger, Jr. et al. | 333/246 X |

FOREIGN PATENT DOCUMENTS

| | | | |
|---|---|---|---|
| 1160702 | 11/1989 | Japan . | |
| 2137775 | 11/1990 | Japan . | |
| 2137772 | 11/1990 | Japan . | |
| 2137773 | 11/1990 | Japan . | |
| 2137774 | 11/1990 | Japan . | |
| 451704 | 2/1992 | Japan . | |
| 451701 | 2/1992 | Japan . | |
| 451702 | 2/1992 | Japan . | |
| 451703 | 2/1992 | Japan . | |
| 2189652 | 10/1987 | United Kingdom | 333/33 |

OTHER PUBLICATIONS

Caccoma et al., *Interface of Strip Line To Coaxial Cable,* IBM Tech. Discl. Bulletin, vol. 13, No. 2, Jul. 1970 pp. 526, 527.

Morton *Matched Impedance Coaxial Cable Connector,* IBM Tech. Discl. Bulletin p. 1335, vol. 17, No. 5, Oct. 1974.

Handbook of Tri–Plate Microwave Components, Sanders Assoc., Nashua, N.H., 1956, Title pages & pp. 37–41.

*Primary Examiner*—Paul Gensler
*Attorney, Agent, or Firm*—Ostrolenk, Faber, Gerb & Soffen

[57] ABSTRACT

In a high frequency parallel strip line cable including a pair of thin-film-shaped earth conductors formed on both surfaces of a dielectric body so as to oppose to each other, a thin-film-shaped center conductor is formed in the dielectric body so as to be located between the pair of earth conductors, and the connector part is formed in one end of the high frequency parallel strip line cable so as to expose one end of the center conductor. Further, a connector is provided for connecting with the connector part of the high frequency parallel strip line cable. In the connector, a connection concave for inserting the connector part is formed in a dielectric case. An elastic center conductor terminal for electrically connecting to the center conductor of the high frequency parallel strip line cable is mounted in the dielectric case so as to extend into the connection concave, and at least one elastic earth conductor terminal for electrically connecting to at least one of the earth conductors of the high frequency parallel strip line cable is mounted in the dielectric case so as to extend into the connection concave.

5 Claims, 13 Drawing Sheets

HIGH FREQUENCY PARALLEL STRIP LINE CABLE COMPRISING CONNECTOR PART AND CONNECTOR PROVIDED ON SUBSTRATE FOR CONNECTING WITH CONNECTOR PART THEREOF

BACKGROUND OF THE INVENTION

1. Field of the Invention

The present invention relates to a high frequency or microwave parallel strip line cable comprising a connector part, and a connector provided on a dielectric: or semiconductor substrate for connecting with the connector part, which are utilized at a frequency band higher than about 800 MHz.

2. Description of the Related Art

Conventionally, as a high frequency or microwave transmission line cable for transmitting a high frequency or microwave signal, a coaxial cable 53 has been widely used which comprises a center conductor 50 buried in a cylindrical dielectric body 51 and an earth conductor 52 of braided wires formed on an outer periphery of the cylindrical dielectric body 51, as shown in FIG. 8 which shows a connection structure between a conventional connector set 60 and the conventional coaxial cable 53. The connector set 60 is provided for connecting with the coaxial cable 53, and comprises a pair of male and female connectors 61 and 62, wherein the male connector 61 is mounted on an end of the coaxial cable 53, and the female connector 62 is formed on a printed circuit board or dielectric substrate 20.

When the coaxial cable 53 is inserted into the male connector 61, the coaxial cable 53 is connected with the male connector 61 so as to be fixed therein. Thereafter, the male connector 61 is inserted into the female connector 62, and fixed therein, thereby electrically connecting the coaxial cable 53 to a circuit formed on the printed circuit board 20.

Accompanying recent down-sizing of electronic units, a demand for down-sizing, in particular, lowering of thickness of connection structures of high frequency or microwave line cables mounted in spaces of inner parts of the electronic units has been heightened. However, the above-mentioned connection structure between the conventional coaxial cable 53 and the conventional connector set 60 leads to such a problem that it is extremely difficult to lower the thickness thereof for the following reasons.

A characteristic impedance $Z_0$ of the coaxial cable 53 is represented by the following equation (1):

$$Z_0 \approx 60/\sqrt{\epsilon r}\ \ln(D/d) \quad (1)$$

where

D is an inner diameter of the earth conductor 52 of the coaxial cable 53;

d is an outer diameter of the center conductor 50 of the coaxial cable 53; and $\epsilon r$ is a dielectric constant or a relative permittivity of the dielectric body 51 of the coaxial cable 53.

The center conductor 50 of the coaxial cable 53 is made of a solid wire or stranded wire, and therefore, the minimum limit of the outer diameter d of the center conductor 50 may be about 0.1 mm because of the manufacturing method thereof. When the dielectric body 51 made of fluorocarbon resin having a dielectric constant $\epsilon r$ of 2.04 is formed around the periphery of the center conductor 50, the minimum limit of the inner diameter D of the earth conductor 52 becomes about 0.33 mm as apparent from the above equation (1).

Further, since the earth conductor 52 is generally made of braided wires, at least about 0.2 mm is required for the thickness of the earth conductor 52. Furthermore, when taking into consideration the thickness of an outer sheath 54 for covering the earth conductor 52, at least about 0.73 mm is required for the outer diameter of the coaxial cable 53.

As mentioned above, there is a limit of down-sizing of such a coaxial cable 53, and the size of the high frequency or microwave transmission lines mounted in the spaces in the inner portions of the electronic units can not be further decreased, in particular, the thickness thereof can not be decreased so as to satisfy the above-mentioned demand.

Furthermore, there is a limit to the possible amount of reduction in size and thickness of the connector set 60.

SUMMARY OF THE INVENTION

An object of the present invention is therefore to provide a high frequency or microwave transmission line cable, which has a smaller size and thickness than those of the conventional high frequency transmission line cables.

Another object of the present invention is to provide a connector formed on a printed circuit board or substrate, which is capable of connecting with the above-mentioned connector part of the transmission line cable.

A further object of the present invention is to provide a connector formed on a printed circuit board or substrate, which has a smaller size and thickness than those of the conventional connectors.

In order to achieve the aforementioned objective, according to one aspect of the present invention, there is provided a high frequency parallel strip line cable comprising:

- a strip-shaped dielectric body;
- a pair of thin-film-shaped earth conductors formed on both surfaces of the dielectric body so as to oppose each other;
- a thin-film-shaped center conductor formed in the dielectric body so as to be located between the pair of earth conductors; and
- a connector part formed in one end of the high frequency parallel strip line cable so as to expose one end of the center conductor.

In the above-mentioned high frequency parallel strip line cable, the dielectric body preferably comprises a pair of thin-film-shaped first and second dielectric sheets.

In the above-mentioned high frequency parallel strip line cable, the dielectric body preferably further comprises a thin-film-shaped further dielectric sheet having a thickness smaller than that of each of the dielectric sheets.

Further, the high frequency parallel strip line cable preferably further comprises a pair of further earth conductors formed on a surface in the dielectric body, whereby the center conductor and the pair of further earth conductors constitute a coplanar line.

In the above-mentioned high frequency parallel strip line cable, each of the thin-film-shaped first and second dielectric sheets is preferably made of a dielectric material having a flexibility such as ethylene tetrafluoride resin, whereby the high frequency parallel strip line cable has a flexibility.

In the above-mentioned high frequency parallel strip line cable, each of the thin-film-shaped first and second dielectric sheets is preferably made of a dielectric material having a plasticity such as polypropylene resin, whereby the high frequency parallel strip line cable has a plasticity.

The above-mentioned high frequency parallel strip line cable preferably further comprises a pair of thin-film-shaped earth conductors formed on both side surfaces of the dielectric body so as oppose to each other.

According to another aspect of the present invention, there is provided a connector for connecting with a connector part of a high frequency parallel strip line cable comprising a pair of thin-film-shaped earth conductors formed on both surfaces of a dielectric body so as oppose to each other, a thin-film-shaped center conductor formed in the dielectric body so as to be located between the pair of earth conductors, and the connector part formed in one end of the high frequency parallel strip line cable so as to expose one end of the center conductor, the connector comprising:

a dielectric case;

a connection concave formed in the dielectric case, for inserting said connector part of said high frequency parallel strip line cable thereinto;

an elastic center conductor terminal mounted in the dielectric case so as to extend into the connection concave, for electrically connecting to the center conductor of the high frequency parallel strip line cable; and at least one elastic earth conductor terminal mounted in the dielectric case so as to extend into the connection concave, for electrically connecting to at least one of the earth conductors of the high frequency parallel strip line cable.

In the above-mentioned connector, the connection concave is preferably formed so that the depth direction of the connection concave is parallel to a surface of a printed circuit board on which the connector is mounted.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

The preferred embodiments according to the present invention will be described below with reference to the attached drawings.

First Preferred Embodiment

Figure 1:
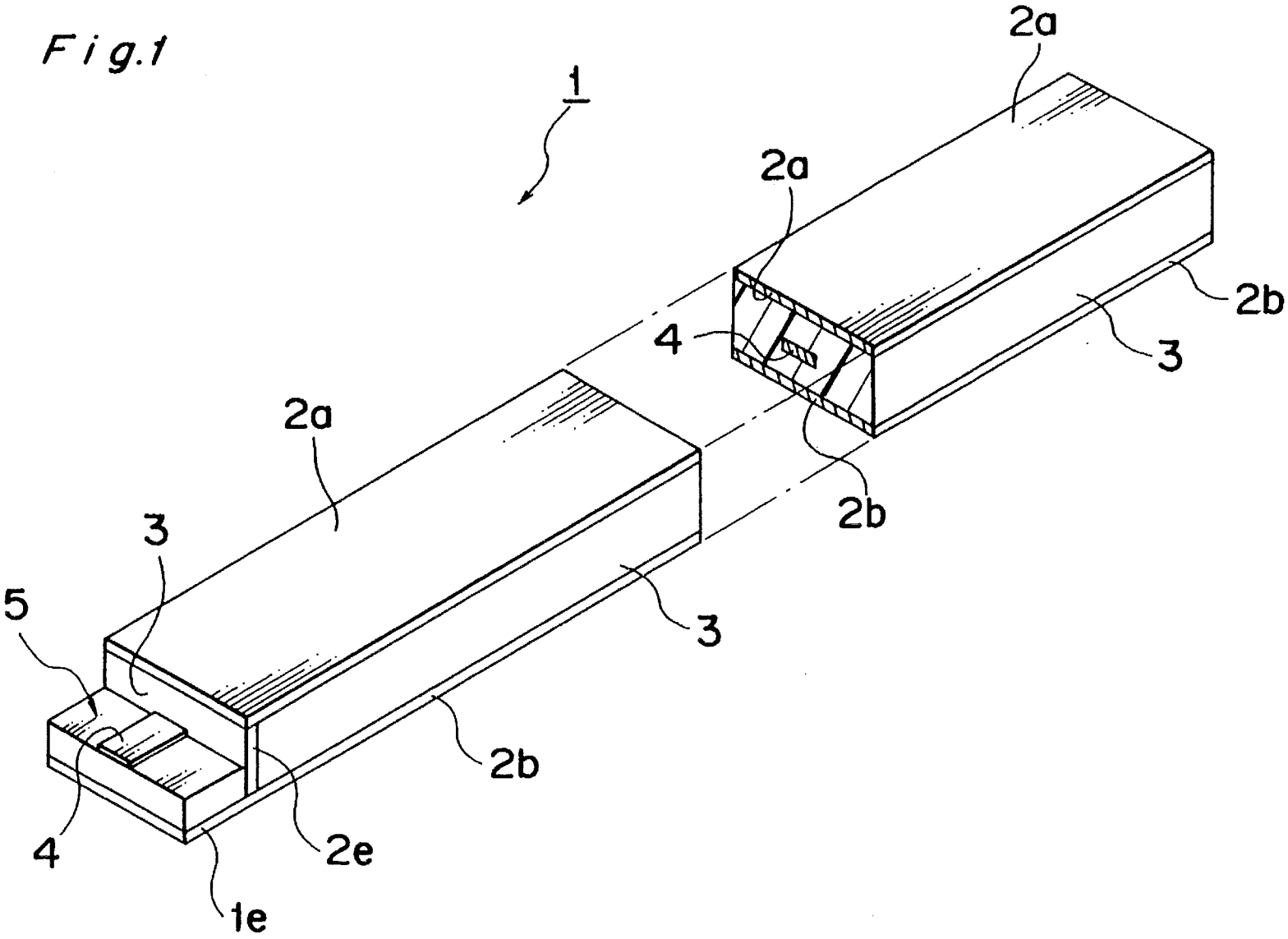
FIG. 1 is a perspective view of a high frequency parallel strip line cable comprising a connector part of a first preferred embodiment according to the present invention.

FIG. 1 shows a high frequency parallel strip line cable 1 comprising a connector part 1*e* of a first preferred embodiment according to the present invention.

Referring to FIG. 1, the parallel strip line cable 1 comprises a pair of thin-film-shaped earth conductors 2*a* and 2*b* which closely oppose each other with a space smaller than the width of each of the earth conductors 2*a* and 2*b*, and the space between a pair of earth conductors 2*a* and 2*b* is filled with a strip-shaped dielectric body 3, which is made of an electrically insulating dielectric material having a flexibility or a plasticity so that the parallel strip line cable has a flexibility or a plasticity. In other words, in this case, a pair of earth conductors 2*a* and 2*b* is formed on both the surfaces of the strip-shaped dielectric body 3.

In the inner portion of the dielectric body 3, a thin-film-strip-shaped center conductor 4 having a width smaller than the width of each of the earth conductors 2*a* and 2*b* is buried so that the distance between the center conductor 4 and the earth conductor 2*a* is substantially the same as that between the center conductor 4 and another earth conductor 2*b*, resulting in the parallel strip line cable 1 wherein the center conductor 4 extends in a longitudinal direction of the parallel strip line cable 1 which is a transmission direction of a high frequency signal so as to be surrounded by a pair of earth conductors 2*a* and 2*b* through the dielectric body 3.

The reasons for being able to achieve the desired downsizing and lowering of the thickness of the parallel strip line cable 1 having the above-mentioned structure are as follows.

The characteristic impedance $Z_0$ of the parallel strip line cable is represented by the following equation (2) or (3).

For $W/(b-t) \geqq 0.35$, $$Z_0 = \frac{94.15}{\sqrt{\epsilon r}\left[\dfrac{\frac{W}{b}}{\left(1-\frac{t}{b}\right)} + \dfrac{Cf}{0.00885\cdot\epsilon r}\right]}, \tag{2}$$

and for $W/(b-t) < 0.35$, $$Z_0 = \frac{60}{\sqrt{\epsilon r}}\cdot\ln\left(\frac{4\cdot b}{\pi\cdot\alpha_0}\right). \tag{3}$$

A parameter Cf in the equation (2) is represented by the following equation (4):

$$Cf = \frac{0.00885\cdot\epsilon r}{\pi}\left[\frac{2}{\left(1-\frac{t}{b}\right)}\cdot\ln\left\{\frac{1}{\left(1-\frac{t}{b}\right)}+1\right\} - \left\{\frac{1}{\left(1-\frac{t}{b}\right)}-1\right\}\cdot\ln\left\{\frac{1}{\left(1-\frac{t}{b}\right)^2}-1\right\}\right]. \tag{4}$$

A parameter $\alpha_0$ in the equation (3) is represented by the following equation (5):

$$\alpha_0 = \frac{w}{2}\left[1+\frac{t}{\pi w}\left\{1+\ln\frac{4\pi w}{t}\right\}+0.51\left(\frac{t}{w}\right)^2\right]. \tag{5}$$

Figure 11:
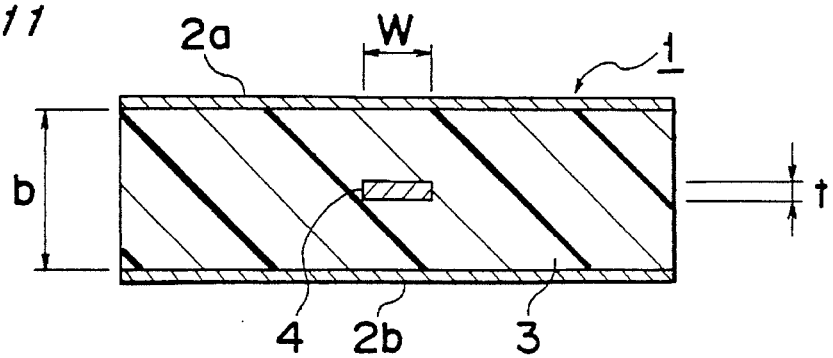
FIG. 11 is a transverse cross-sectional view of the connector part of the parallel strip line cable on line XI—XI' of FIG. 9.

In the above equations (2) to (5) , as shown in FIG. 11,

W is a width of the center conductor 4, t is a thickness of the center conductor 4, $\epsilon r$ is a dielectric constant of the dielectric body 3, and b is a thickness of the dielectric body 3.

As is apparent from the above equations (2) to (5), when the characteristic impedance $Z_0$ is constant, as the thickness t of the center conductor 4 becomes smaller, the thickness b of the dielectric body 3 becomes smaller. Since the center conductor 4 of the parallel strip line cable 1 can be constituted by a thin film such as a film made by a sputtering method, a film made by a vapor deposition method or the like, the thickness t of the center conductor is easily made smaller. Accordingly, when the thickness of the center conductor 4 is set to be smaller, the thickness of the parallel strip line cable 1 can be made smaller.

When the parallel strip line cable 1 having a characteristic impedance of 50 Ω is designed so as to comprise the dielectric body 3 made of fluorocarbon resin having a dielectric constant $\epsilon r$ of 2.04, (a) the width W of the center conductor 4 is 0.2 mm;

(b) the thickness t of the center conductor 4 is 0.005 mm; and (c) the thickness of the dielectric body 3 is 0.25 mm. Further, when the thickness of each of the earth conductors 2*a* and 2*b* is 0.005 mm which is the same as that of the center conductor 4, the thickness of the parallel strip line cable 1 becomes about 0.34 mm, which is about half the outer diameter of a conventional coaxial cable having substantially the same performances.

Figure 2A:
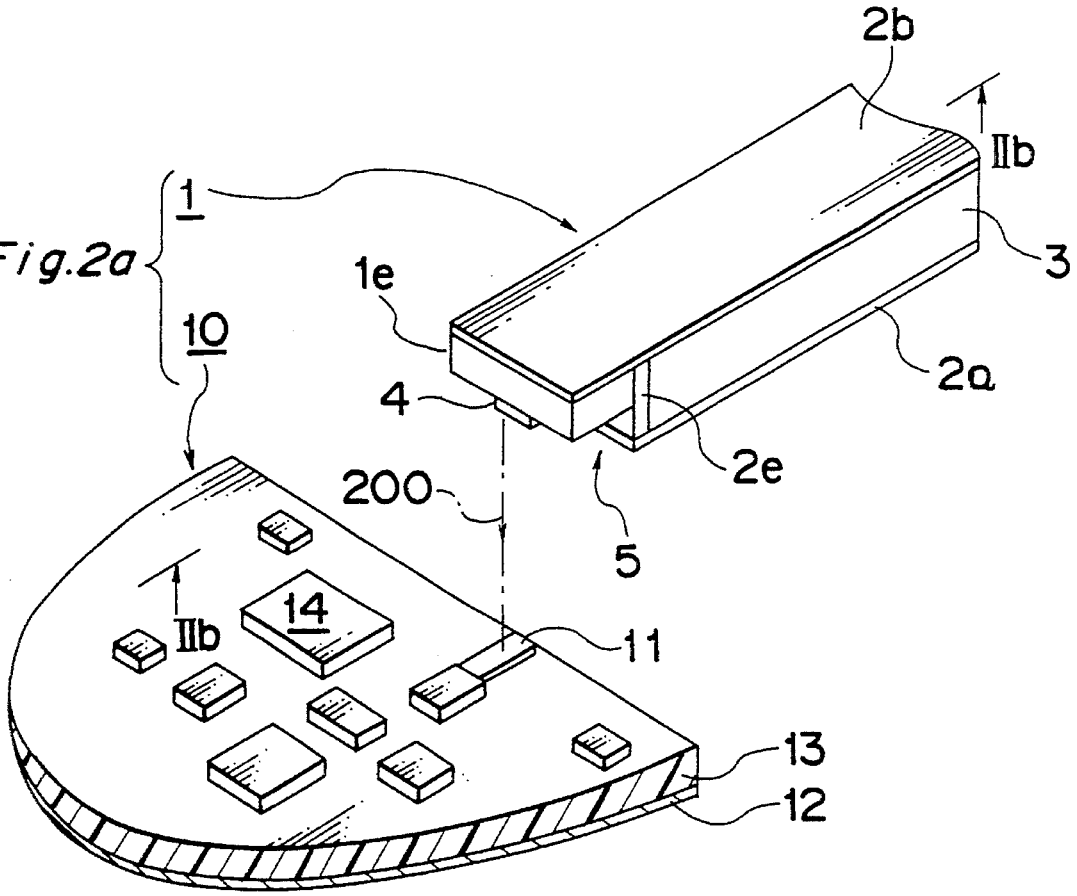
FIG. 2*a* is a perspective view showing a connection structure between the connector part of the parallel strip line cable shown in FIG. 1 and a microstrip line formed on a dielectric substrate.

In one end of the above-mentioned parallel strip line cable 1, a cutting part 5 which becomes the connector part 1*e* is formed by cutting or removing the earth conductor 2*a* and the dielectric body 3 in a direction of the thickness of the parallel strip line cable 1 from the side of the earth conductor 2*a* by a predetermined length in the longitudinal direction of the parallel strip line cable 1 so as to expose the center conductor 4 in the longitudinal direction thereof, as shown in FIGS. 1 and 2*a*.

It is to be noted that, as shown in FIGS. 1 and 2*a*, the end of the earth conductor 2*b* is electrically connected to the earth conductor 2*a* through Cu conductors 2*e* which are formed by a Cu plating on both sides of the dielectric body 3. As a result, there is obtained the connector part 1*e* having the predetermined length in the longitudinal direction of the parallel strip line cable 1.

Figure 2B:
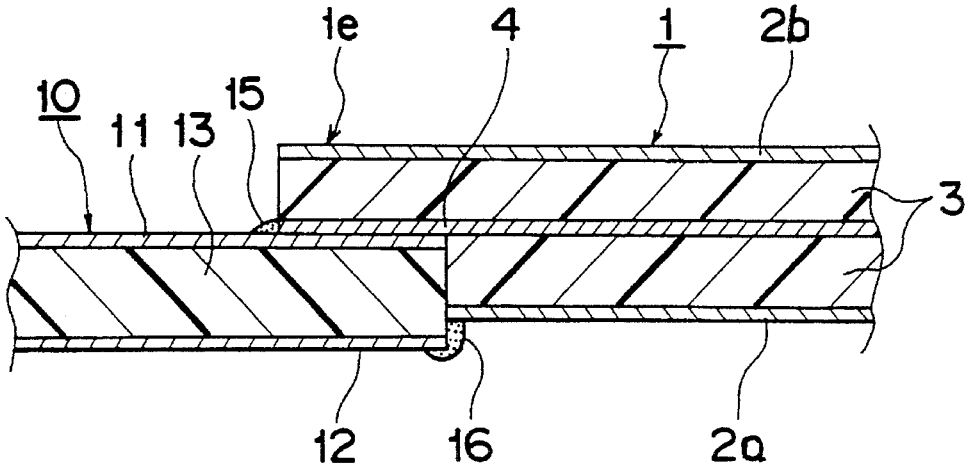
FIG. 2*b* is a longitudinal cross-sectional view of the connection structure shown on line IIb—IIb of FIG. 2*a;*

A connection structure between the connector part 1*e* of the parallel strip line cable 1 shown in FIG. 1 and a microstrip line conductor 11 formed on a dielectric substrate 10 will be described with reference to FIGS. 2*a* and 2*b*.

The dielectric substrate 10 comprises a dielectric layer 13 and an earth conductor layer 12 which is formed on substantially the entire surface of the dielectric layer 13, and electronic circuits 14 are formed on the dielectric substrate 10. The microstrip line conductor 11 extends to one end of the dielectric substrate 10. The above-mentioned dielectric substrate 10 may be a semiconductor substrate in which FETs are formed.

As is indicated by an arrow 200 of FIG. 2*a*, the connector part 1*e* of the parallel strip line cable 1 is in contact with the dielectric substrate 10 making the exposed center conductor 4 oppose the end of the microstrip line conductor 11, so that the center conductor 4 is in contact with the microstrip line conductor 11. Then, as shown in FIG. 2*b*, the center conductor 4 is electrically connected to the microstrip line conductor 11 by solder 15 using a soldering method, and the earth conductor 2*b* is electrically connected to the earth conductor 12 by solder 16 using a soldering method. Instead of the soldering method, a welding method may be used.

The connection structure has the following advantageous effects.

(a) Since the center conductor 4 is exposed, the electrical connection can be easily made by a relatively simple connection method such as a soldering method, a welding method or the like.

(b) Since the connection structure becomes more simple, the size of the connection can be made relatively small.

(c) The connector part 1*e* has substantially half the thickness of the parallel strip line cable 1 since the earth conductor 2*a* and the dielectric body 3 are cut or removed so as to expose the center conductor 4.

Accordingly, the connector part 1*e* of the parallel strip line 1 can be made smaller, in particular, the thickness of the connector structure can be made smaller.

Figure 3:
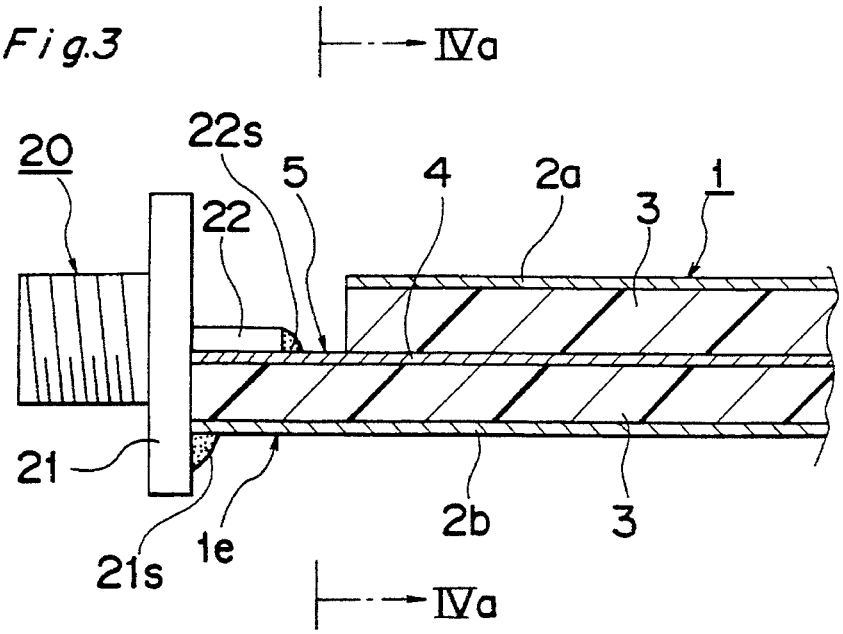
FIG. 3 is a longitudinal cross-sectional view of a connection structure between the connector part of the parallel strip line cable and a coaxial cable connector, showing another preferred embodiment according to the present invention.

FIG. 3 shows a connection structure between the connector part 1*e* of the parallel strip line cable 1 and a coaxial cable connector 20, of another preferred embodiment according to the present invention.

Referring to FIG. 3, the above-mentioned parallel strip line cable 1 may be connected with the coaxial cable connector 20. In this case, an outer conductor flange 21 of the coaxial cable connector 20 is in contact with the end surface of the connector part 1*e* of the parallel strip line cable 1, and an inner conductor 22 of the coaxial cable connector 20 is in contact with the exposed center conductor 4. In such a state, by an electrical connecting method such as a soldering method, a welding method or the like, the center conductor 4 is electrically connected to the inner conductor 22 through solder 22*s*, and the earth conductor 4 is electrically connected to the outer conductor flange 21 through solder 21*s*.

Such a connection structure between the connector part 1*a* of the parallel strip line cable 1 and the coaxial cable connector 20 has the following advantageous effects.

(a) Since the center conductor 4 is exposed, the electrical connection can be easily made by a relatively simple connection method such as a soldering method, a welding method or the like.

(b) Since the connection structure becomes more simple, the size of the connection can be made relatively small.

(c) The connector part 1*e* has substantially half the thickness of the parallel strip line cable 1 since the earth conductor 2*a* and the dielectric body 3 are cut or removed so as to expose the center conductor 4.

Accordingly, the connector part 1*e* of the parallel strip line 1 can be made smaller, in particular, the thickness of the connector structure can be made smaller.

Figure 4A:
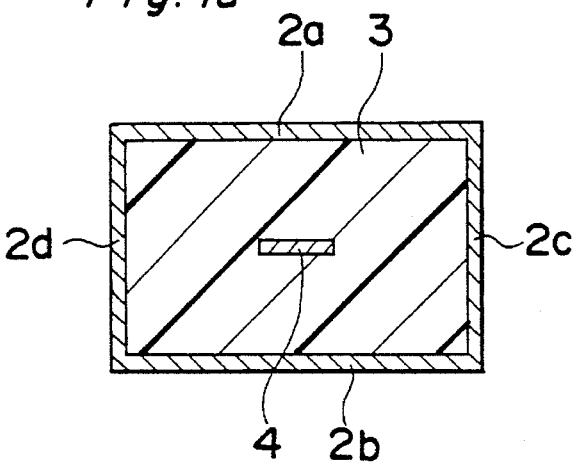
FIG. 4*a* is a transverse cross-sectional view of the connector part of the parallel strip line cable on line IVa—IVa of FIG. 3.

The above-mentioned parallel strip line cable 1 is shown in FIGS. 1, 2*a*, 2*b* and 3, however, the present invention is not limited to this. As shown in FIG. 4*a*, the entire surfaces of the dielectric body 3 may be covered by the earth conductors 2*a*, 2*b*, 2*c* and 2*d*, resulting in a shield type parallel strip line cable. In this case, a pair of earth conductors 2*c* and 2*d* oppose to each other.

Figure 4B:
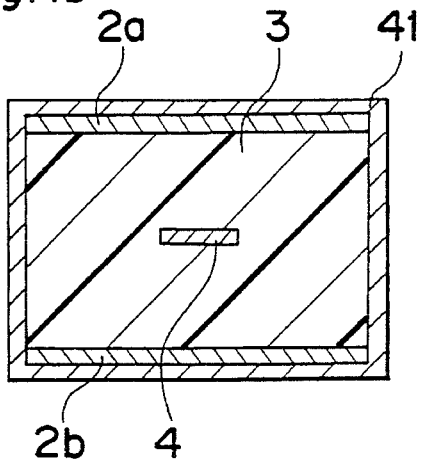
FIG. 4*b* is a transverse cross-sectional view of a connector part of a parallel strip line cable of a further preferred embodiment on line IVa—IVa of FIG. 3.
Figure 4C:
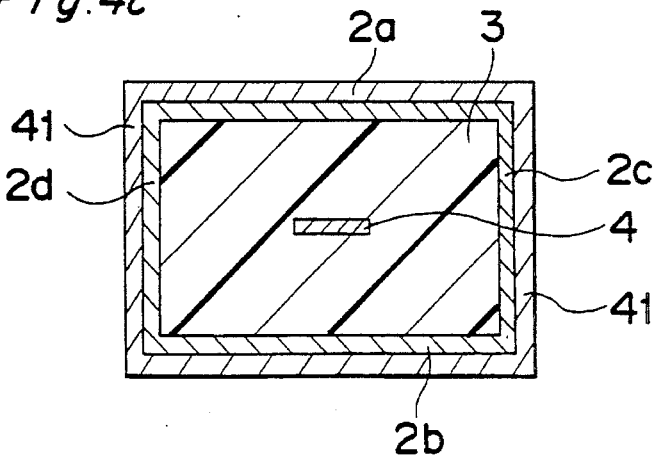
FIG. 4*c* is a transverse cross-sectional view of a connector part of a parallel strip line cable of a still further preferred embodiment on line IVa—IVa of FIG. 3.

The entire surfaces of shield type parallel strip line cable, i.e., the top, bottom and both side surfaces thereof may be further covered by a laminating resin 41, as shown in FIG. 4*c*, in order to establish electrical insulation between the earth conductors 2*a*, 2*b*, 2*c* and 2*d* and the other members or devices.

Furthermore, as shown in FIG. 4*b*, the entire surfaces of the parallel strip line cable 1, i.e., the top, bottom and both side surfaces thereof may be covered by the laminating resin 41 in order to establish electrical insulation between the earth conductors 2*a*, 2*b*, 2*c* and 2*d* and the other members or devices, wherein the laminating resin 41 is formed on the outer surfaces of the earth conductors 2*a* and 2*b* and on the side surfaces of the dielectric body 3.

Figure 5:
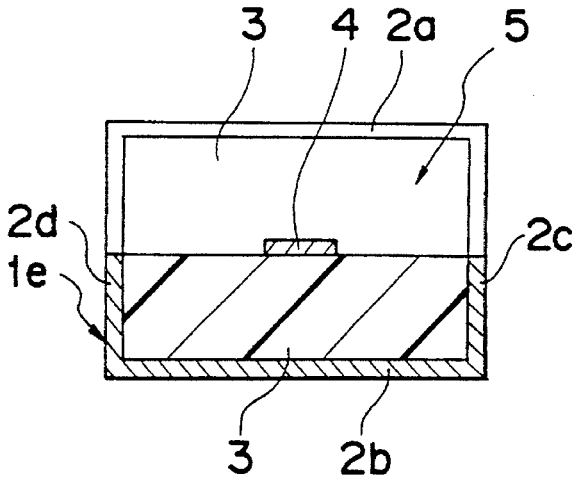
FIG. 5 is a transverse cross-sectional view of a connector part of a parallel strip line cable of a modification of the first preferred embodiment according to the present invention.

Further, instead of the connector part 1*e* shown in FIG. 1, as shown in FIG. 5, the earth conductors 2*c* and 2*d* may be formed so as to extend to the side surfaces of the connector part 1*e*. Furthermore, as shown in FIG. 6*a*, a coplanar line 43 comprising the center conductor 4 and a pair of earth conductors 42*a* and 42*b* formed on both sides of the center conductor 4 ]nay be formed on a surface 6 of the dielectric body 3 of the connector part 1*e* on which the center conductor 4 is formed so as to be exposed.

Figure 6A:
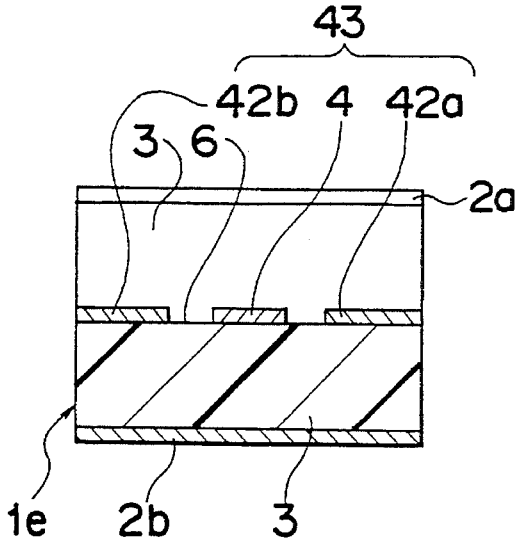
FIG. 6*a* is a transverse cross-sectional view of a connector part of a parallel strip line cable comprising a coplanar line of another preferred embodiment according to the present invention.
Figure 6B:
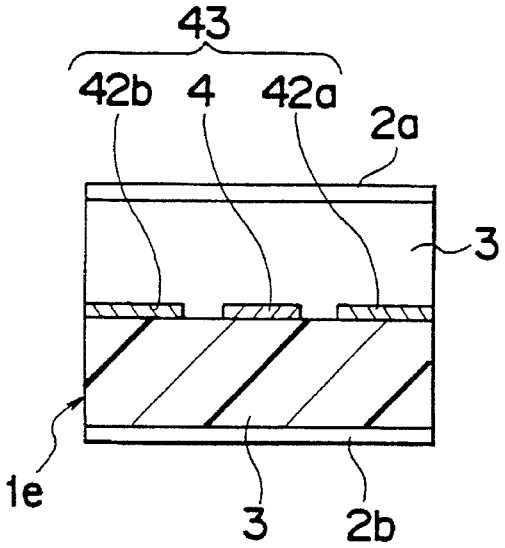
FIG. 6*b* is a transverse cross-sectional view of a connector part of a parallel strip line cable comprising a coplanar line of a further preferred embodiment according to the present invention.
Figure 6C:
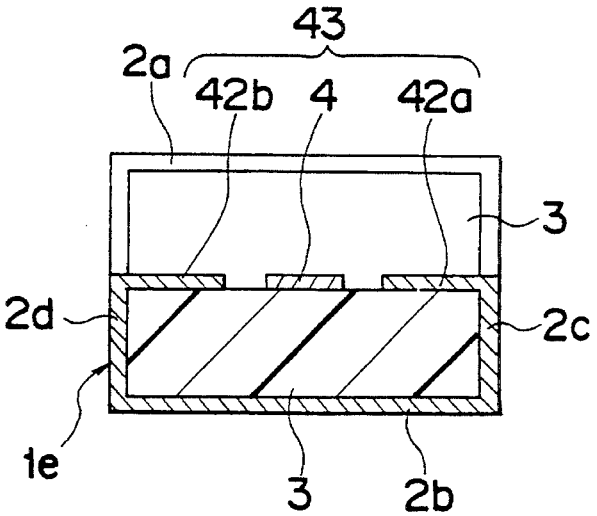
FIG. 6*c* is a transverse cross-sectional view of a connector part of a parallel strip line cable comprising a coplanar line of a still further preferred embodiment according to the present invention.

In the case of the type of coplanar line 43 shown in FIG. 6*a*, the earth conductor 2*b* of the connector part 1e may be cut or removed as shown in FIG. 6*b*. Further, in the case of the type of coplanar line 43 shown in FIG. 6*a*, the earth conductors 2*c* and 2*d* formed on the side surfaces of the parallel strip line cable 1 may be formed so as to extend to one end thereof. It is to be noted that FIGS. 6*a* to 6*c* are transverse cross-sectional views of the connector part 1*e* of the parallel strip line cable 1.

Figure 7:
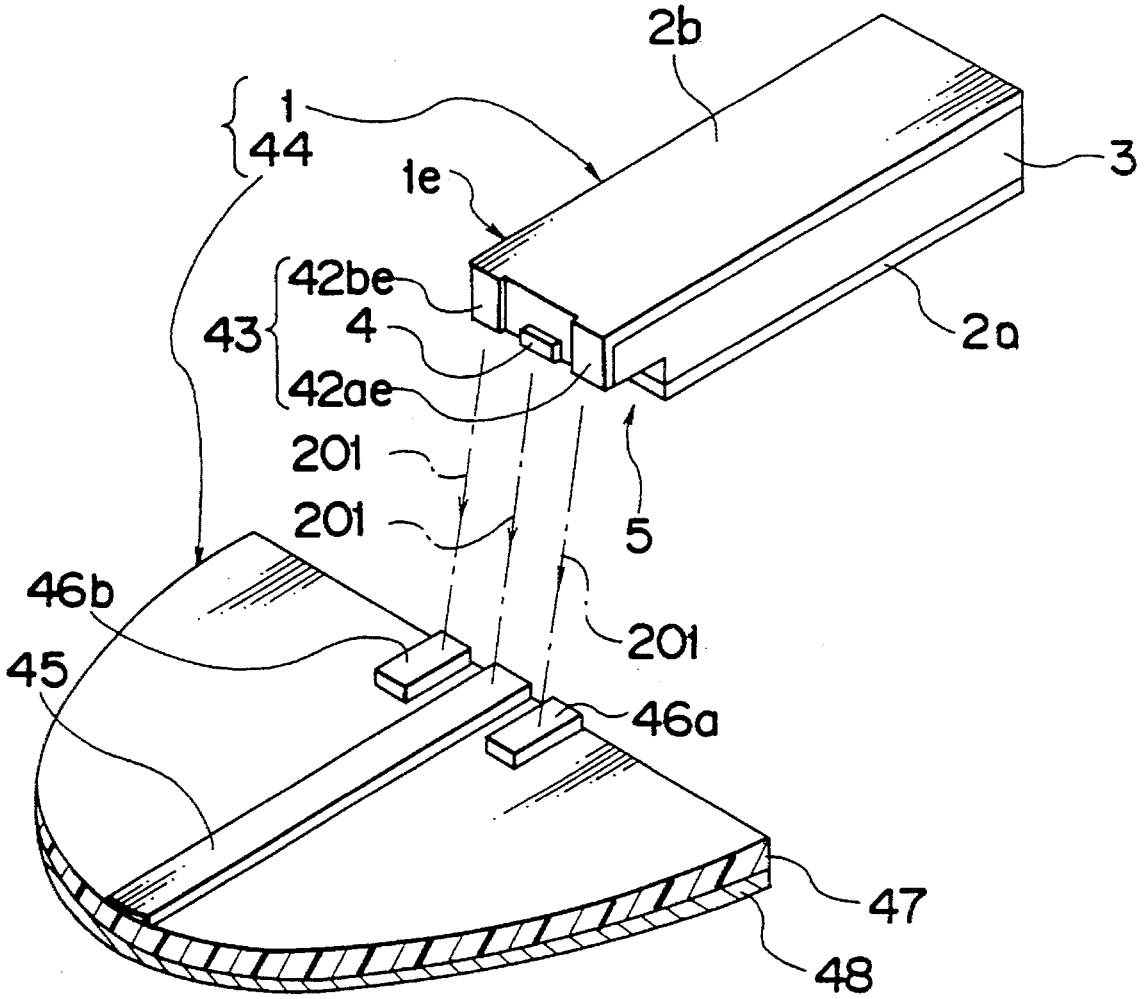
FIG. 7 is a perspective view of a connection structure between the parallel strip line cable comprising the coplanar line and a further coplanar line formed on the dielectric substrate.

FIG. 7 is a perspective view of another connection structure between the parallel strip line cable 1 comprising the coplanar line 43 and a further coplanar line formed on a dielectric substrate 44 comprising a dielectric layer 47 and an earth conductor 48 which is formed on the entire surface of the dielectric layer 47. On the dielectric substrate 44, a microstrip line conductor 45 is formed so as to extend to the end of the dielectric substrate 44, while earth conductors 46*a* and 46*b* are formed on both side surfaces of the microstrip line conductor 45 on the end of the dielectric substrate 44, resulting in the coplanar line on the dielectric substrate 44. On the other hand, a coplanar line 43 comprising the center conductor 4 and earth conductors 42*ae* and 42*be*, which are formed on the end surface of the dielectric body 3 so as to be located on both sides of the center conductor 4 and are connected to the earth conductor 2*a*, is formed on the end surface of the parallel strip line cable 1.

As is indicated by an arrow 201 of FIG. 7, the center conductor 4 is electrically connected to the microstrip line conductor 45 through solder, and also the earth conductors 42*ae* and 42*be* are electrically connected to the earth conductors 46*a* and 46*b* through solder.

The coplanar line structure of the connector part 1*e* shown in FIG. 7 has the structure shown in FIG. 6*a*, however, the present invention is not limited to this. The coplanar line structure of the connector part 1*e* shown in FIG. 7 may have the structure shown in FIG. 6*b* or 6*c*. As shown in FIG. 6*b*, the earth conductor 2*b* formed on the bottom surface of the dielectric body 3 located in the connector part 1*e* may be removed. Further, as shown in FIG. 6*c*, a pair of earth conductors 2*c* and 2*d* may be formed on both side surfaces of the dielectric body 3 located in the connector part 1*e* so as to oppose each other, and then the bottom earth conductor 2*b* is electrically connected through the side earth conductor 2*c* to the earth conductor 42*a* and is also electrically connected through the side earth conductor 2*d* to the earth conductor 42*b*.

Further, a modification 402 of the parallel strip line cable 1 of the first preferred embodiment will be described hereinafter with reference to FIGS. 16*a* to 16*e*, 17 and 18. The features of the modification 402 of the first preferred embodiment are as follows.

(a) the dielectric body 3 comprises a pair of thin-film-shaped dielectric sheets 303*a* and 303*b*, and a thin-film-shaped dielectric adhering sheet 306, both surfaces of which an adhering agent is coated.

(b) Each of the center and earth conductor sheets 304, 302*a* and 302*b* is made of Cu foil.

FIGS. 16*a* to 16*e* show a manufacturing process for manufacturing the high frequency parallel strip line cable 402 of the modification of the first preferred embodiment.

Figure 16A:
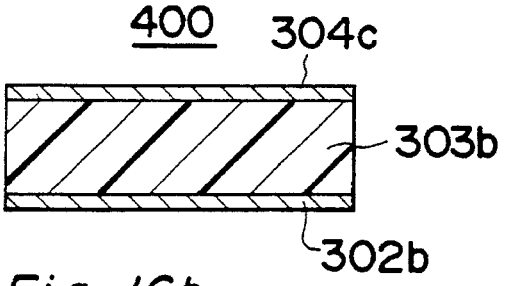
FIGS. 16*a*, 16*b*, 16*c*, 16*d* and 16*e* are a transverse cross-sectional view of a high frequency parallel strip line cable of a modification of the first preferred embodiment according to the present invention, showing a manufacturing process therefor.
Figure 16B:
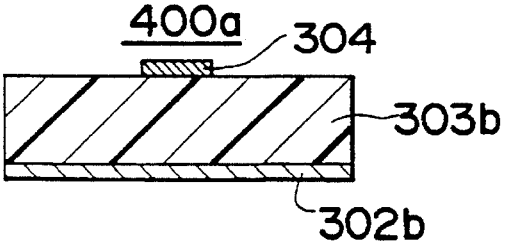

FIG. 16*a* shows a combination sheet 400 comprising the dielectric sheet 303*b* formed between the conductor sheets 304*c* and 302*b* each of Cu foil. Then as shown in FIG. 16*b*, the conductor sheet 304*c* is etched by a pattern etching method so as to make a thin-film-strip-shaped center conductor 304 remain on the dielectric sheet 303*b*, resulting in a combination sheet 400*a*. On the other hand, as shown in FIG. 16*c*, there is prepared another combination sheet 401 comprising a dielectric sheet 303*a* and a conductor sheet 302*a* of Cu foil which is formed on one surface of the dielectric sheet 303*a*.

Figure 16C:
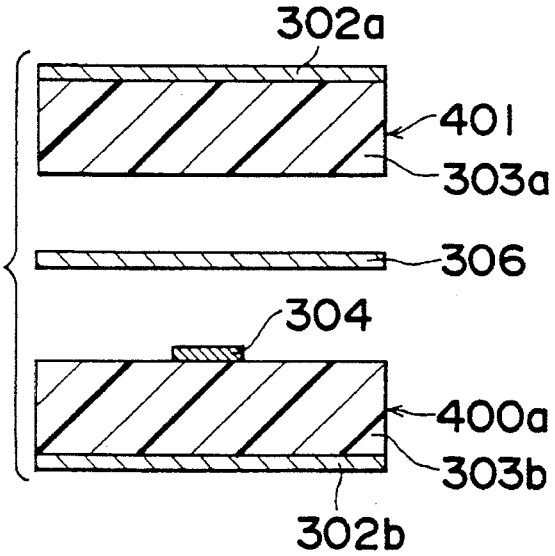
Figure 17:
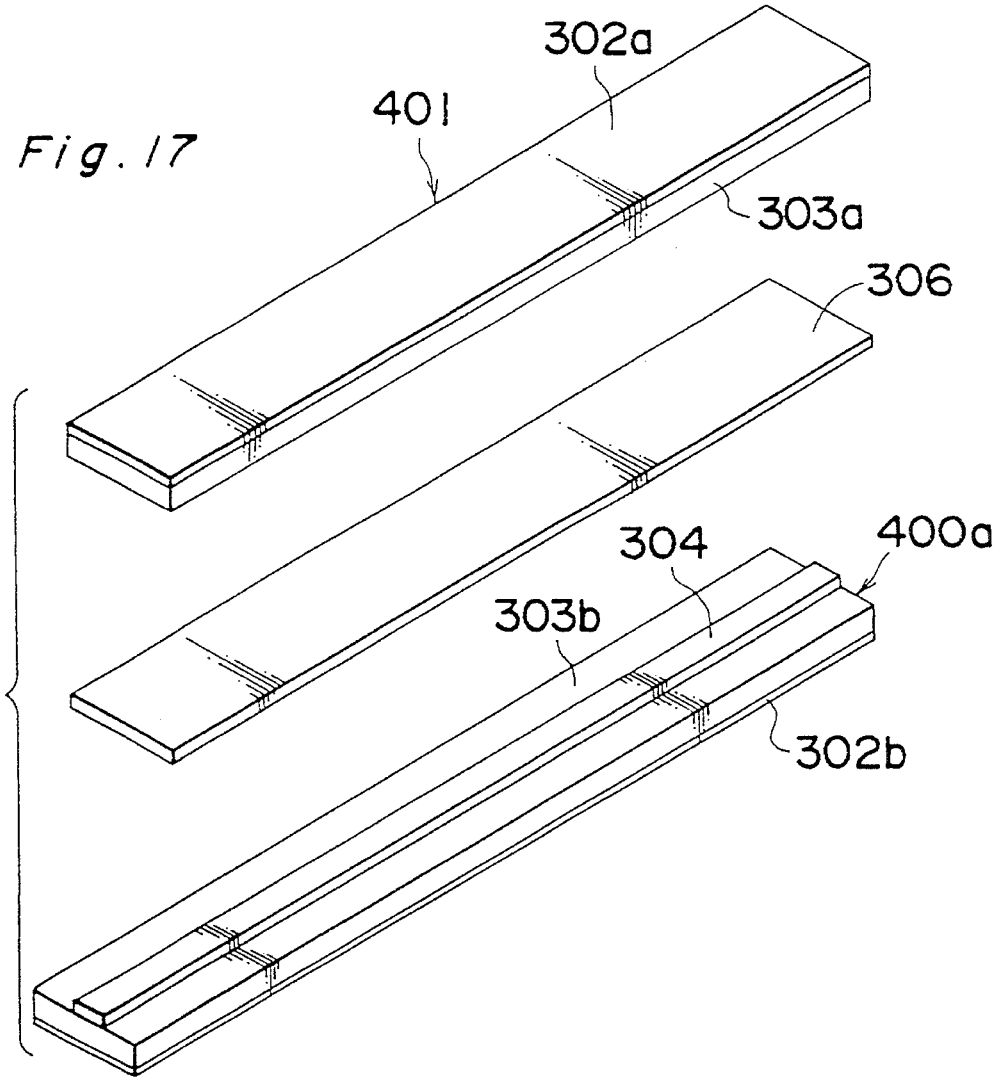
FIG. 17 is a perspective view of respective components of the high frequency parallel strip line cable shown in FIGS. 16*a* to 16*e*.

Further, as shown in FIGS. 16*c* and 17, the combination sheets 401, 306 and 400*a* are combined or assembled so as to be adhered together with each other, such that a surface of the dielectric sheet 303*a* on which no conductor sheet is formed opposes one surface of the dielectric adhering sheet 306 and a surface of the dielectric sheet 303*b* on which the center conductor 304 is formed opposes to another surface of the dielectric adhering sheet 303*b*. This assembling is performed so that the center conductor 304 is exposed by a predetermined length in the longitudinal direction of the parallel strip line cable 402. In other words, the combination sheets 401 and 306 are provided on the sheet 400*a* so as to be shifted from each other in the longitudinal direction of the parallel strip line cable 402 by the above-mentioned predetermined length, i.e., so as to expose the center conductor 304.

Figure 16D:
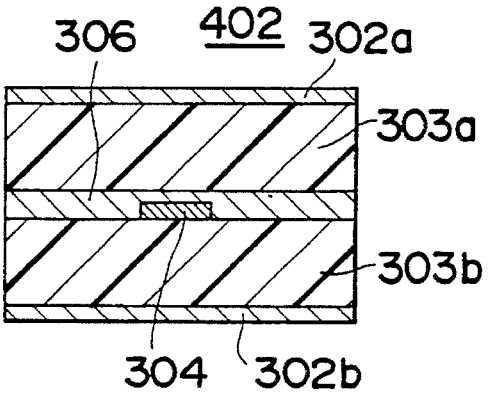
Figure 16E:
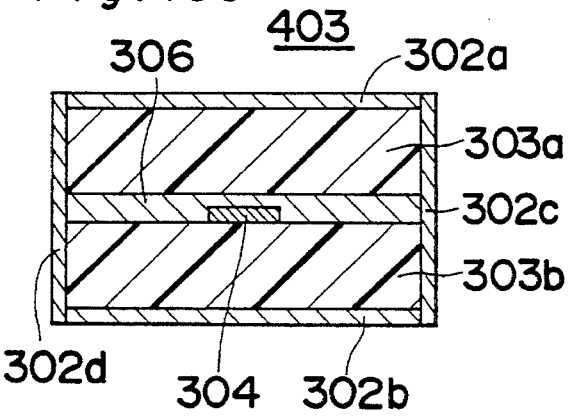
Figure 18:
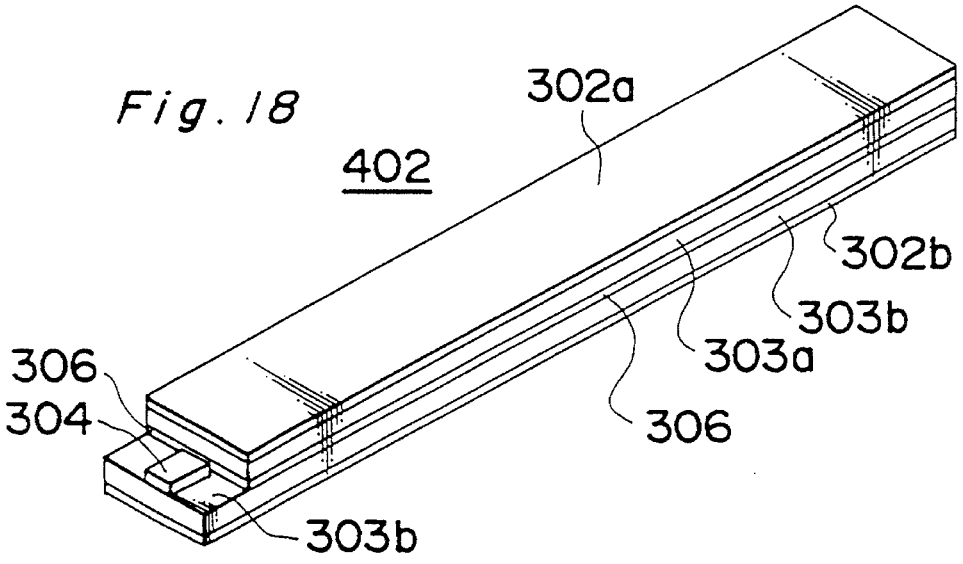
FIG. 18 is a perspective view of the assembled high frequency parallel strip line cable shown in FIGS. 16*a* to 16*e*.

Thereafter heat is added to the assembled one as shown in FIG. 16*d* at a predetermined temperature for a predetermined time. Then the sheets 303*a*, 306 and 303*b* are fused, jointed or attached together with each other, as shown in FIG. 18. Thereafter, the earth conductor sheet 302*a* is electrically connected to the earth conductor sheet 302*b* through Cu conductors 302*c* and 302*d* formed by a Cu plating on both side surfaces of the dielectric sheets 303*a*, 303*b* and 306.

In the preferred embodiment, the thickness of each of the dielectric sheets 303*a* and 303*b* is preferably 0.25 mm, the thickness of the dielectric adhering sheet 306 is preferably 10 μm, the thickness of each of the conductor sheets 302*a*, 302*b* and 304 is preferably 50 μm. In this case, the thickness of the parallel strip line cable becomes about 0.5 mm.

Since the thickness of the dielectric adhering sheet is much smaller than that of each of the conductor sheets 302*a*, 302*b* and 304, the thickness of the dielectric adhering sheet 306 does not influence the flexibility and the plasticity of the parallel strip line cable 402. When each of the dielectric sheets 303*a* and 303*b* is made of ethylene tetrafluoride resin, the assembled parallel strip line cable 402 has a flexibility. On the other hand, when each of the dielectric sheets 303*a* and 303*b* is made of polypropylene resin, the assembled parallel strip line cable 402 has a plasticity.

Since the parallel strip line cable of the preferred embodiment has the flexibility and/or the plasticity much more than those of the conventional coaxial cables, the parallel strip line cable 402 can be used for a wiring in small spaces between a case and a printed circuit board, and also a wiring with a high density on or between components or devices formed on a dielectric or semiconductor substrate. When using the conventional coaxial cable, the whole length thereof tends to become longer since it has not a relatively large flexibility or a relatively large plasticity. Accordingly, an efficient wiring can be obtained when using the parallel strip line cable 402 of the present invention.

As mentioned above, the parallel strip line cables 1 and 402 each comprising the connector part 1*e* has a much smaller size, and in particular, has a much smaller thickness. The method for manufacturing the parallel strip line cables 1 and 402 is very simple, and also thin films required therefor can be formed with a relatively smaller manufacturing cost. Further, the whole structure of the parallel strip line cables 1 and 402 each comprising the connector part 1*e* is suitable for mass production. Accordingly, the whole manufacturing cost therefor can be remarkably decreased.

In this preferred embodiment, the Cu foil is used, however, Ag or Au foil may be used, or a Cu conductor made by a Cu plating may be used. In this preferred embodiment, the adhering sheet 306 may not be provided between a pair of dielectric sheets 303*a* and 303*b*.

In this preferred embodiment, the thin-film-shaped adhering sheet 306, on both surfaces of which the adhering agent is coated, is used, however, any adhering agent is not coated. In this case, joining, adhering or attaching of the sheets 302*a*, 303*a*, 306 and 303*b* may be performed by a thermal fusing method. In other words, the sheet 306 is melted while a part of the sheets 303*a* and a part of sheet 303*b* are melted, and then these sheets 303*a*, 306 and 30*b* are jointed or fused together with each other.

Second Preferred Embodiment

Figure 9:
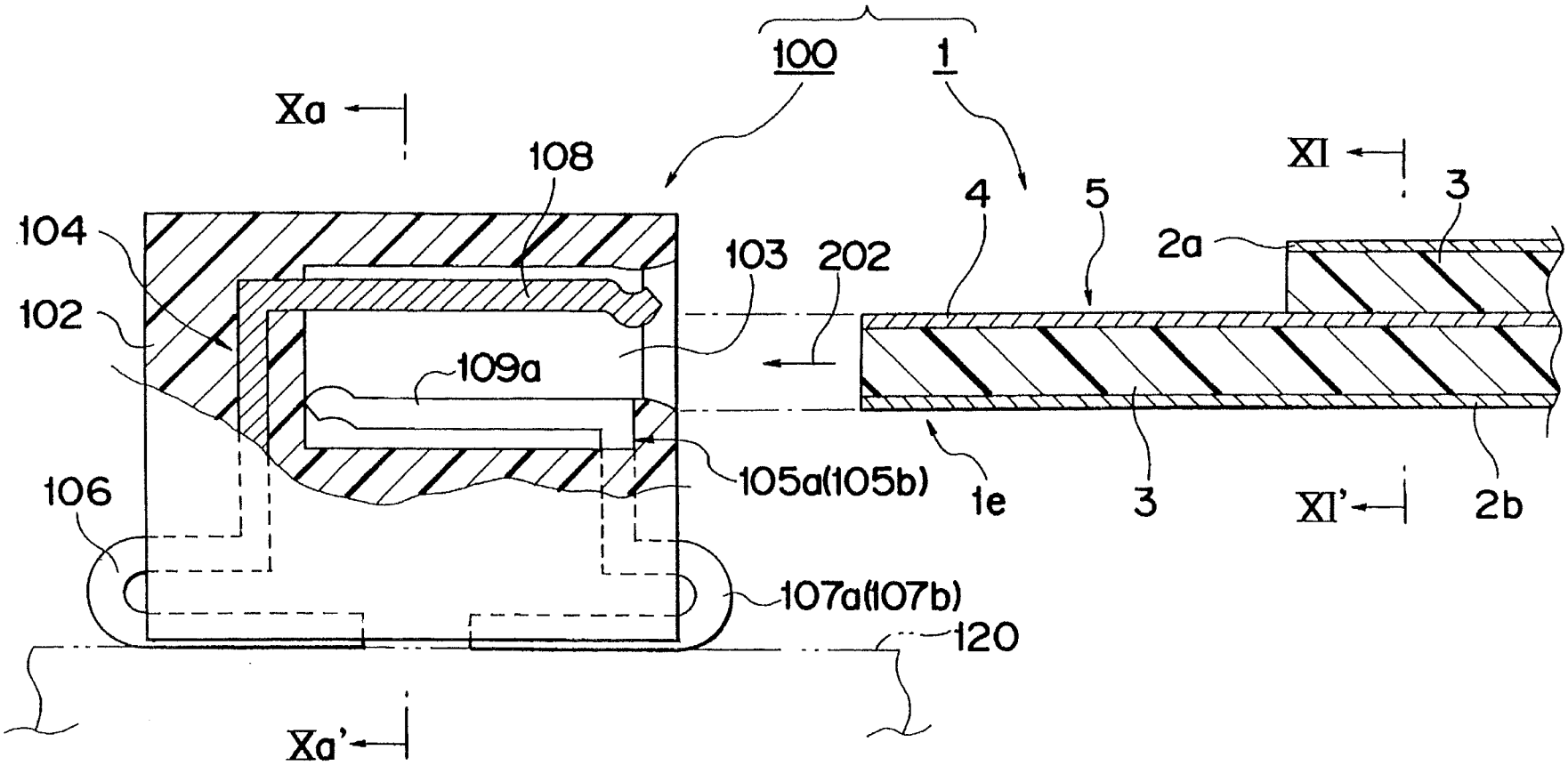
FIG. 9 is a longitudinal cross-sectional view showing a connection structure between the connector part of the high frequency parallel strip line cable shown in FIG. 1 and a connector of a second preferred embodiment according to the present invention.
Figure 10A:
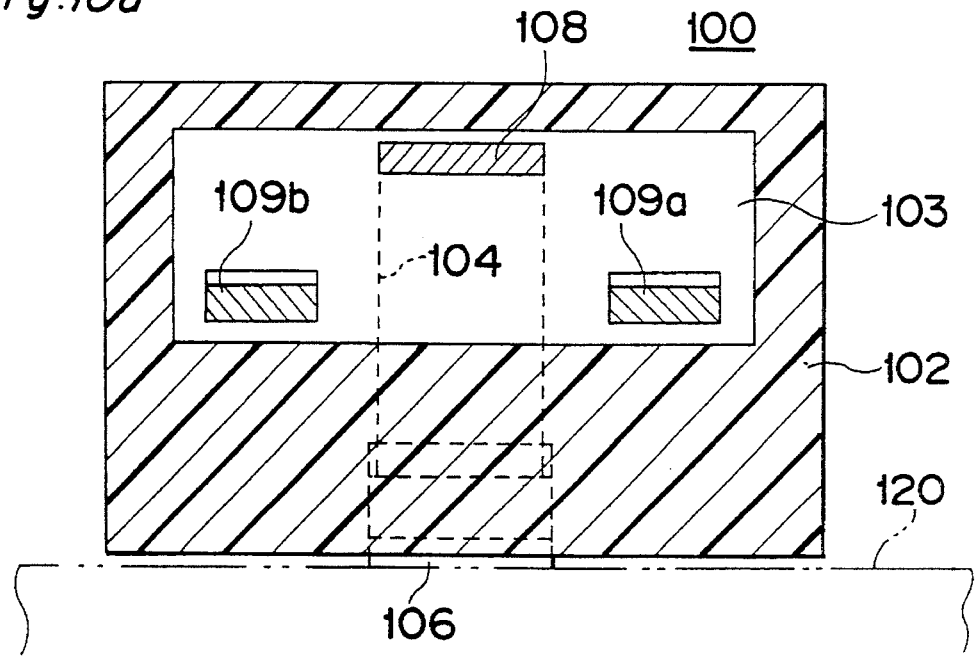
FIG. 10*a* is a transverse cross-sectional view of the connector of the second preferred embodiment on line Xa—Xa' of FIG. 9.

FIG. 9 shows a connection structure between the connector part 1*e* of the high frequency parallel strip line cable 1 shown in FIG. 1 and a connector 100 of a second preferred embodiment according to the present invention, and FIG. 10*a* is a transverse cross-sectional view of the connector of the second preferred embodiment on line Xa— Xa' of FIG. 9 and FIG. 11 is a transverse cross-sectional view of the connector of the second preferred embodiment on line XI—XI' of FIG. 9.

Referring to FIG. 9, the connector 100 comprises a dielectric case 102 having a shape of substantially a cube. A rectangular-parallelepiped-shaped connection slot 103 is formed in a side surface of the dielectric case 102 so that a depth direction of the connection slot 103 is parallel to a surface on which the dielectric case 102 is mounted or provided, i.e., a surface of a printed circuit board 120. In other words, the depth direction of the connection slot 103 is parallel to the horizontal direction.

In the dielectric case 102, a center conductor terminal 104 and a pair of earth conductor terminals 105*a* and 105*b* are mounted so as to be sealed. Respective ends of these terminals 104, 105*a* and 105*b* are exposed to a bottom surface of the dielectric case 102, respectively, so as to become connection parts 106, 107*a* and 107*b* which are to be connected with the printed circuit board 120 on which the connector 100 is mounted or attached. Another end of the center conductor terminal 104 is extended and exposed into the connection slot 103 from the vicinity of the top end of the bottom side in the depth direction of the connection slot 103, and extends to an aperture of the connection slot 103, preferably, so as to provide a space between an inner top wall of the connection slot 103 and the center conductor terminal 104. On the other hand, another end of the earth conductor terminal 105*a* is extended and exposed into the connection slot 103 from the vicinity of the bottom end of the aperture of the connection slot 103, and extends to the bottom side in the depth direction of the connection slot 103, preferably, so as to provide a space between another inner bottom wall of the connection slot 103 and the earth conductor terminal 105*a*. Further, another end of the earth conductor terminal 105*b* is also extended and exposed in'to the connection slot 103 from the vicinity of the bottom end of the aperture of the connection slot 103, and extends to the bottom side in the depth direction of the connection slot 103, preferably, so as to provide a space between another inner bottom wall of the connection slot 103 and the earth conductor terminal 105*b*. Therefore, the respective another ends of the conductor terminals 105*a* and 105*b* are located so as to be parallel in the bottom end of the connection slot 103, as shown in FIG. 10*a*.

Then the respective another ends of these conductor terminals 104, 105*a* and 105*b* constitute an elastic terminal 108 for the center conductor, an elastic terminal 109*a* for the earth conductor and an elastic terminal 109*b* for the earth conductor, respectively, as shown in FIG. 10*a*. In this case, an interval between the elastic terminal 108 for the center conductor and each of the elastic terminals 109*a* and 109*b* for the earth conductors is set to a value slightly smaller than an interval between the center conductor 4 and the earth conductor 2*b* of the parallel strip line cable 1.

A connection structure between the connector 100 and the parallel strip line cable 1 of the first preferred embodiment shown in FIG. 1 will be described below.

The connector 100 is previously connected with a circuit formed on the printed circuit board 120, and the parallel strip line cable 1 has the above-mentioned connector part 1*e*. The longitudinal length of the connector part 1*e*, i.e., the longitudinal length of the cut earth conductor 2*a* and the cut dielectric body 3 is set to substantially the same as the depth of the connection slot 103.

The connector part 1*e* of the parallel strip line cable 1 is inserted into the connection slot 103 of the connector 100, in such a state that the surface of the exposed center conductor 4 is directed upward, the center conductor 4 opposes to the elastic terminal 108 for the center conductor, and also the earth conductor 2*b* opposes to the elastic terminals 109*a* and 109*b* for the earth conductors. When the connector part 1*e* has been inserted into the connection slot 103, the elastic terminal 108 for the center conductor is electrically connected to the center conductor 4 and also the elastic terminals 109*a* and 109*b* for the earth conductors are electrically connected to the earth conductor 2*b* by elastic forces of the elastic terminals 108, 109*a* and 109*b*.

The connector 100 shown in FIG. 9 can be also used for the connector part of the parallel strip line cable 402 of the modification of the first preferred embodiment shown in FIG. 18.

Figure 10B:
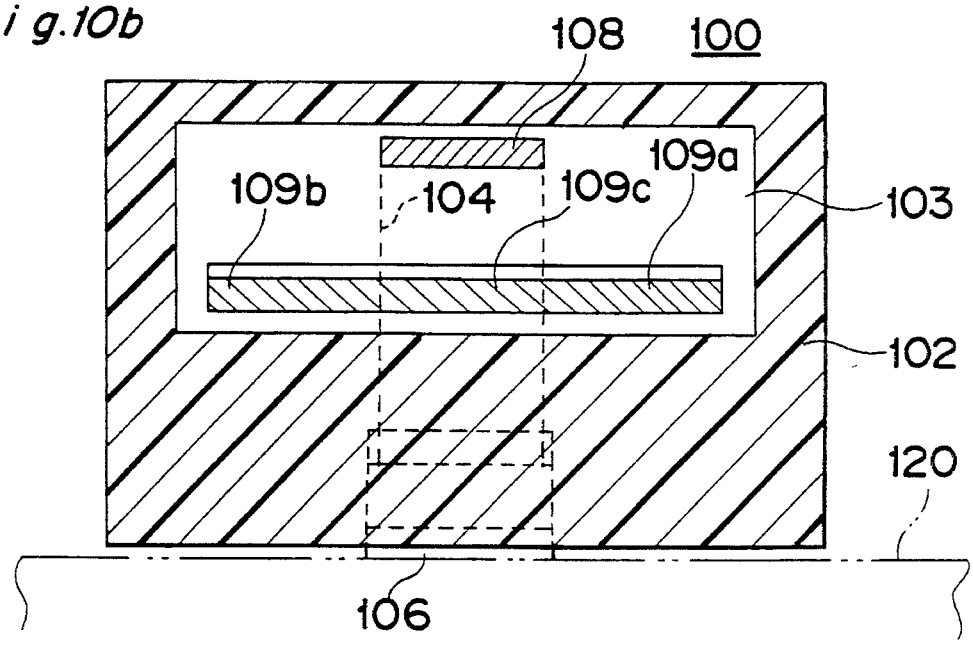
FIG. 10*b* is a transverse cross-sectional view of a connector of a modification of the second preferred embodiment, which corresponds to the cross-sectional view shown in FIG. 10*a;*

In the second preferred embodiment, as shown in FIG. 10*b*, both ends of the elastic terminals 109*a* and 109*b* may be electrically connected through a connection member 109c which is integrally formed with the elastic terminals 109*a* and 109*b*.

FIG. 11 shows that the center conductor has a width W and a thickness t while the dielectric body has a thickness b.

Figure 12:
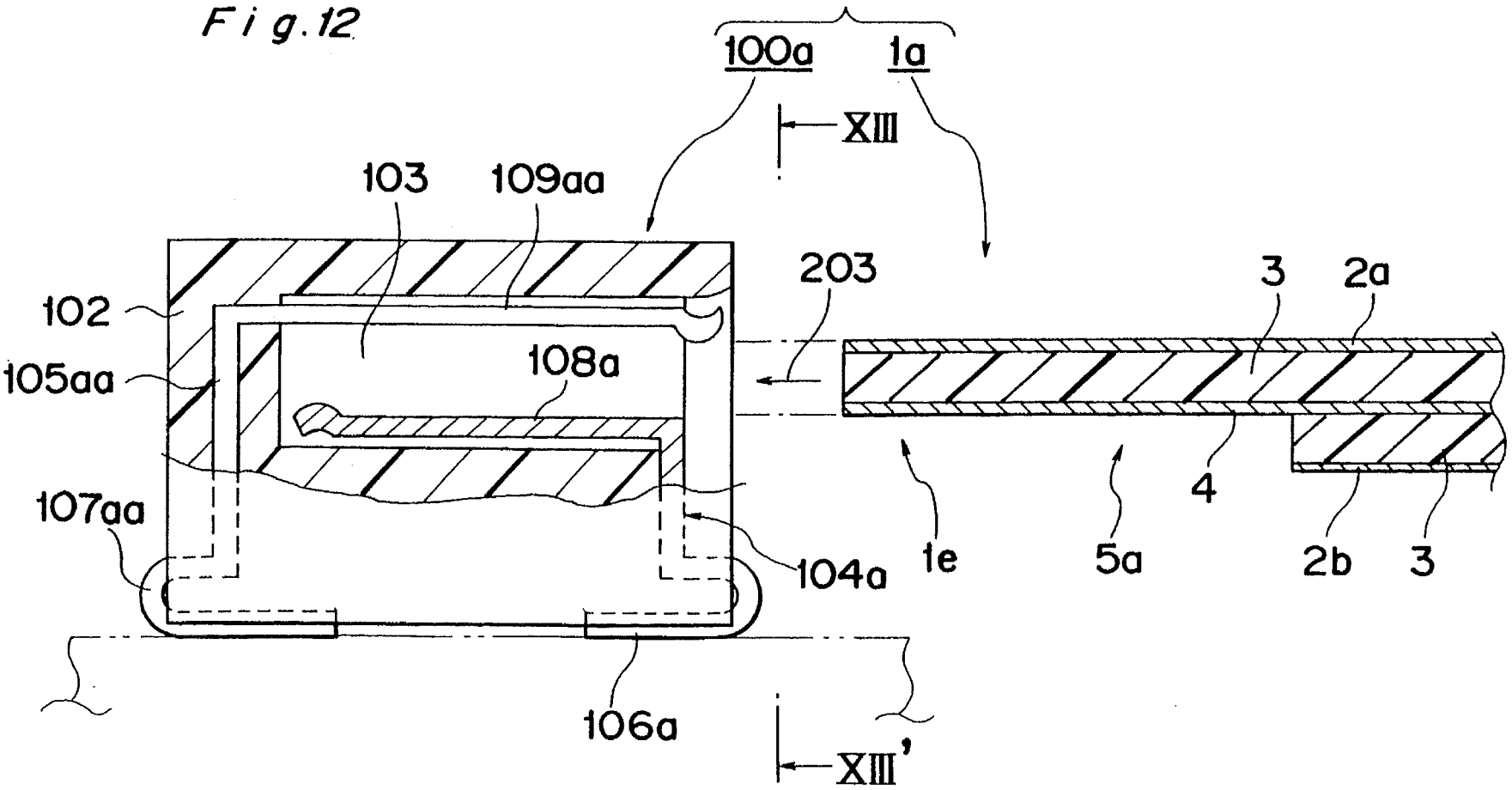
FIG. 12 is a longitudinal cross-sectional view showing a connection structure between a connector part of a high frequency parallel strip line cable and a connector of a first modification of the second preferred embodiment according to the present invention.
Figure 13:
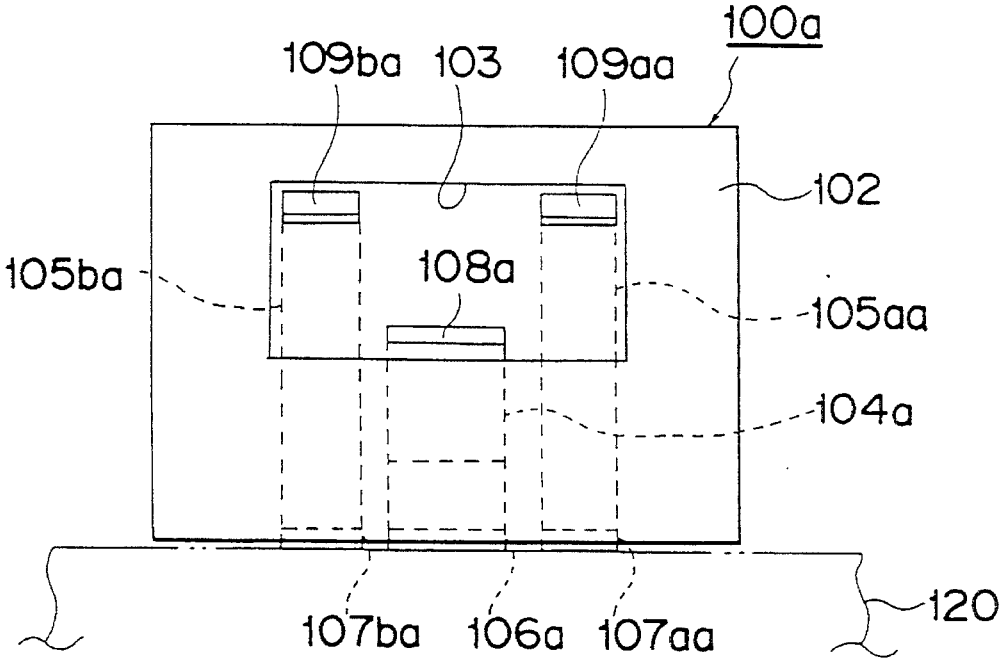
FIG. 13 is a front view of the connector of the first modification of the second preferred embodiment on line XIII—XIII' of FIG. 12.

FIG. 12 shows a connection structure between a connector part 1*e* of a high frequency parallel strip line cable 1*a* and a connector 100*a* of a first modification of the second preferred embodiment according to the present invention, and FIG. 13 is a front view of the connector 100*a* on line XIII—XIII' of FIG. 12.

As shown in FIGS. 12 and 13, the parallel strip line cable 1*a* has the same structure as that of the parallel strip line cable 1 of the first preferred embodiment, except for that a cutting part 5*a* is formed in the lower part of the cable 1*a* by cutting or removing the earth conductor 2*b* and the dielectric body 3 so as to expose the center conductor 4. In the connector 100*a*, elastic terminals 109*aa* and 109*ba* for earth conductors may be located so as to be parallel to each other in the vicinity of the top part of the connection slot 103, while an elastic terminal 108*a* for center conductor may be located in the vicinity of the bottom part of the connection slot 103 in the above-mentioned second preferred embodiment. In this case, the connection part 1e is inserted into the connection slot 103 in such a state that the cutting part 5*a* is directed downward. A center conductor terminal 104*a* comprises a connection part 106*a* of one end thereof and the elastic terminal 108*a* of another end thereof, an earth conductor terminal 105*aa* comprises a connection part 107*aa* of one end thereof and the elastic terminal 109*aa* of another end thereof, and an earth conductor terminal 105*ba* comprises a connection part 107*ba* of one end thereof and the elastic terminal 109*ba* of another end thereof. In this modification shown in FIGS. 12 and 13, the thickness of the connector 100*a* is much smaller than that of the connector 100 of the second preferred embodiment.

Figure 15:
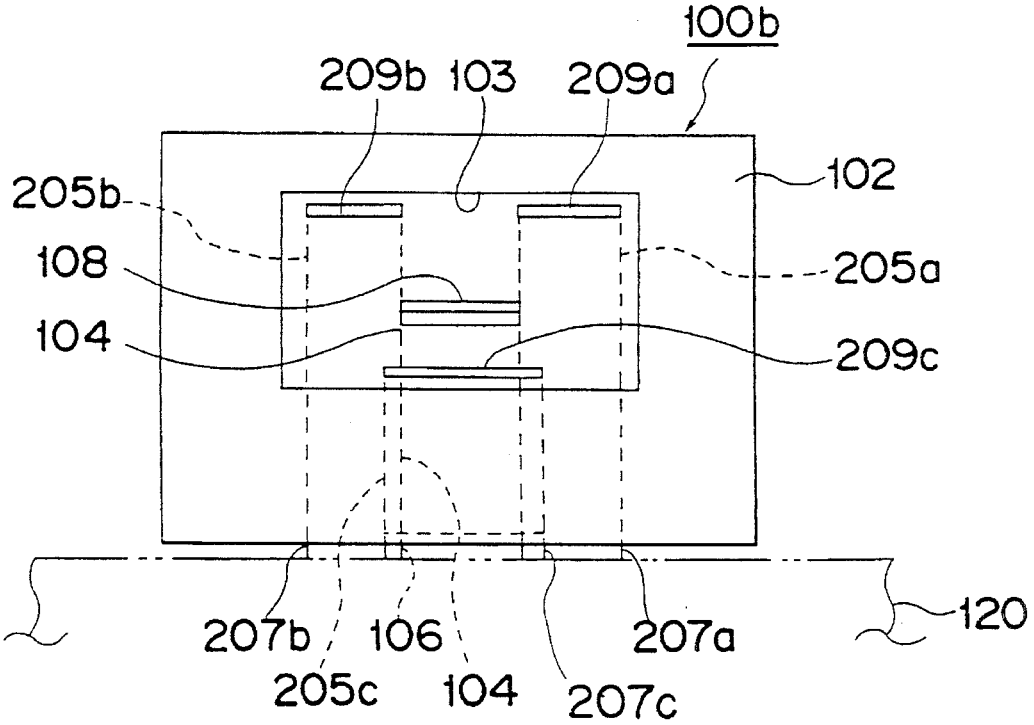
FIG. 15 is a front view of the connector of the second modification of the second preferred embodiment on line XV—XV' of FIG. 14.
Figure 14:
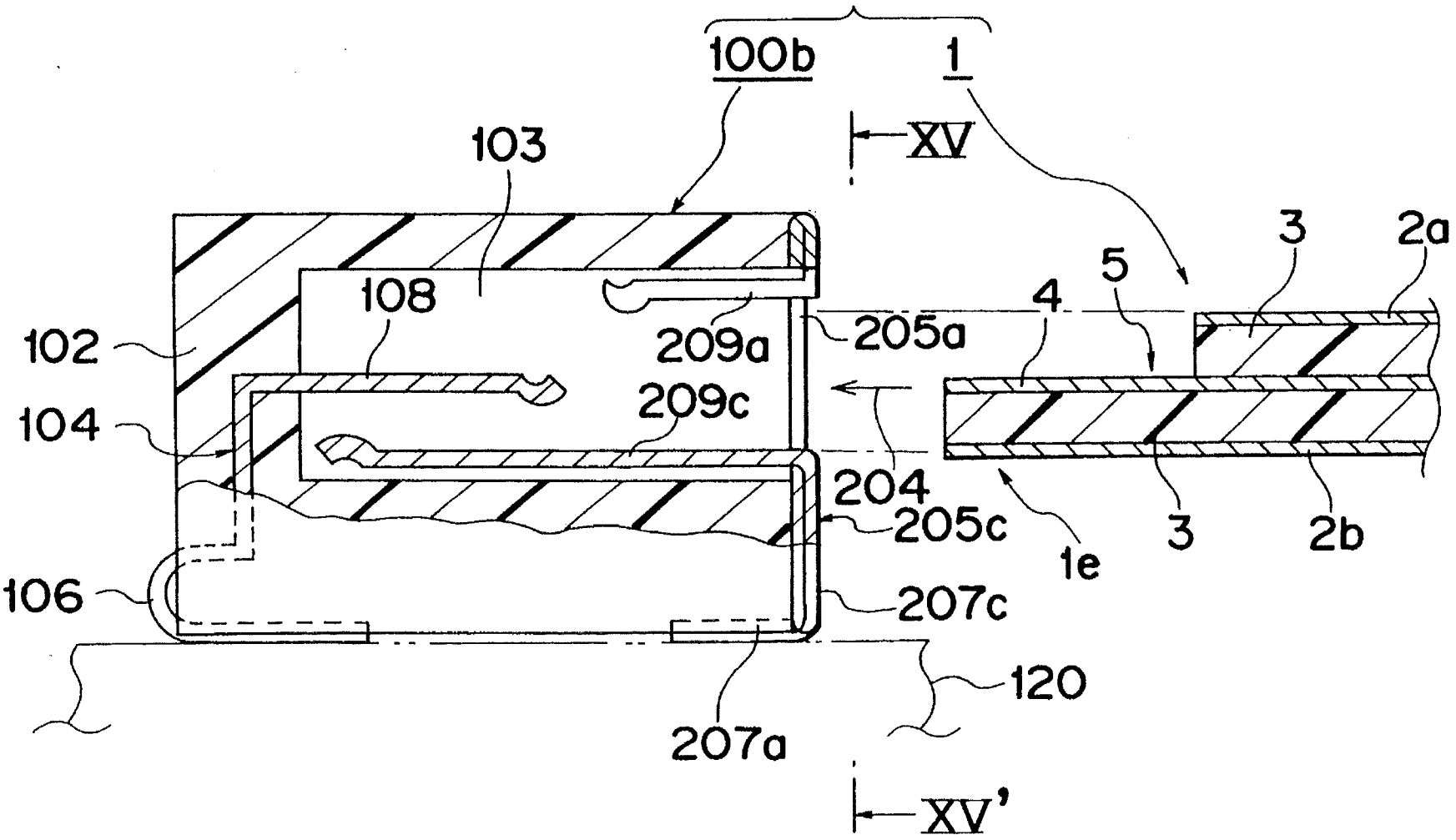
FIG. 14 is a longitudinal cross-sectional view showing a connection structure between the connector part of the high frequency parallel strip line cable shown in FIG. 1 and a connector of a second modification of the second preferred embodiment according to the present invention.

FIG. 14 shows a connection structure between the connector part 1*e* of the high frequency parallel strip line cable 1 shown in FIG. 1 and a connector 100*b* of a second modification of the second preferred embodiment according to the present invention, and FIG. 15 is a front view of the connector 100*b* on line XV—XV' of FIG. 14.

As shown in FIGS. 14 and 15, in the connector 100*b*, elastic terminals 209*a* and 209*b* for the earth conductor may be located so as to be parallel to each other in the vicinity of the top part of the connection slot 103, while an elastic terminal 108 for the center conductor may be located in the vicinity of the center of the connection slot 103, in the above-mentioned second preferred embodiment. Further, another elastic terminal 209*c* for the earth conductor may be located in the vicinity of the bottom part of the connection slot 103. In this case, the longitudinal length of the connection part 1*e* is set to about half the depth in the horizontal direction of the connection slot 103, and then, the connection part 1e and a part of the parallel strip line cable 1 connected to the connection part 1*e* is inserted into the connection slot 103 in such a state that the cutting part 5 is directed upward. The center conductor terminal 104 comprises the connection part 106 of one end thereof and the elastic terminal 108 of another end thereof. An earth conductor terminal 205*a* comprises a connection part 207*a* of one end thereof and the elastic terminal 209*a* of another end thereof, an earth conductor terminal 205*b* comprises a connection part 207*b* of one end thereof and the elastic terminal 209*b* of another end thereof, and further an earth conductor terminal 205*c* comprises a connection part 207*c* of one end thereof and the elastic terminal 209*c* of another end thereof.

In the second modification of the second preferred embodiment shown in FIGS. 14 and 15, the length in the vertical direction of the aperture of the connection slot 103 is set to be substantially the same as the thickness of the parallel strip line cable 1.

Figure 8:
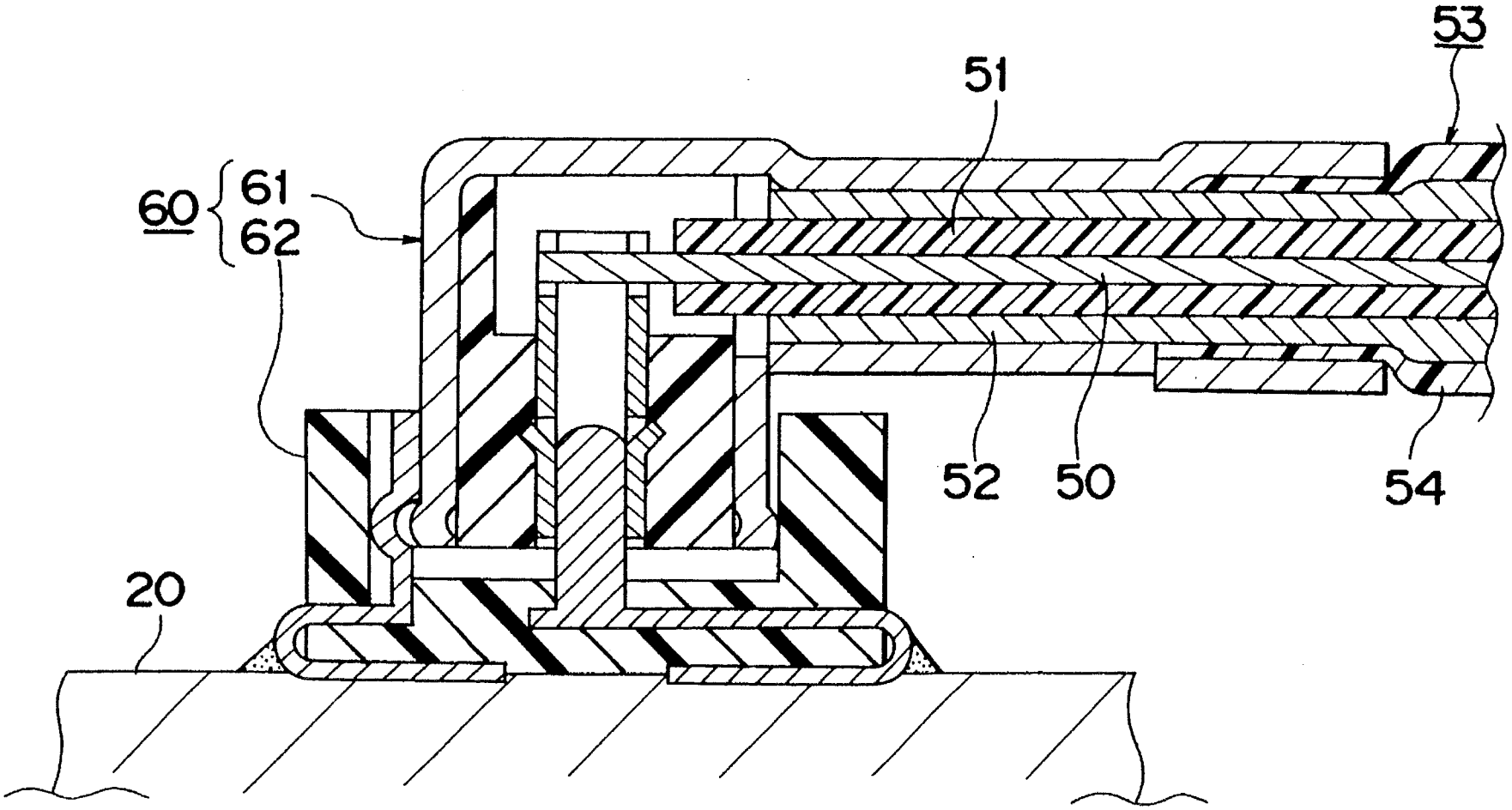
Fig.8 PRIOR ART
FIG. 8 is a longitudinal cross-sectional view showing a connection structure between a conventional connector set comprising a pair of male and female connectors and a conventional coaxial cable.

According to the second preferred embodiment, there can be provided the connector 100 capable of connecting with the connector part 1*e* of each of the parallel strip line cables 1 and 402. The connector part 1*e* has substantially half the thickness of each of the parallel strip line cables 1 and 402, and the connector 100 of the second preferred embodiments does not have a pair of male and female connectors, but rather a single connector component. Accordingly, the size of the connection structure therebetween can be smaller than that of the conventional one shown in FIG. 8, and in particular, the thickness of the connection structure can be smaller than that thereof.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A surface mount device connector for connecting with a connector part of a high frequency parallel strip line cable comprising a pair of thin-film earth conductors formed on both surfaces of a dielectric body so as to oppose each other, a thin-film center conductor formed in said dielectric body so as to be located between said pair of earth conductors, and said connector part formed in one end of said high frequency parallel strip line cable so as to expose one end of said center conductor, said connector comprising:

a dielectric case having a bottom surface, said dielectric case being mounted on a substrate so that the bottom surface of said dielectric case is in contact with said substrate;

a connection slot formed in said dielectric case receiving said connector part of said high frequency parallel strip line cable thereinto;

an elastic center conductor terminal mounted in said dielectric case so as to extend through said connection slot to the bottom of said dielectric case, for electrically connecting an electrical conductor formed on said substrate to said center conductor of said high frequency parallel strip line cable; and at least one elastic earth conductor terminal mounted in said dielectric case so as to extend through said connection slot to the bottom surface of said dielectric case, for electrically connecting an electrical earth conductor formed on said substrate to at least one of said earth conductors of said high frequency parallel strip line cable.

2. The connector as claimed in claim 1, wherein said connection slot is formed so that a depth direction of said connection slot is parallel to a surface of a printed circuit board on which said connector is mounted.

3. The connector as claimed in claim 2, wherein said elastic center conductor terminal is located in the vicinity of the top part of said connection slot, and said elastic earth conductor terminal is located in the vicinity of the bottom part of said connection slot.

4. The connector as claimed in claim 2, wherein said elastic center conductor terminal is located in the vicinity of the bottom part of said connection slot, and said elastic earth conductor terminal is located in the vicinity of the top part of said connection slot.

5. The connector as claimed in claim 2, wherein said elastic center conductor terminal is located in the center of said connection slot, said one elastic earth conductor terminal is located in the vicinity of the top part of said connection slot, and a further elastic earth conductor terminal is located in the vicinity of the bottom part of said connection slot.

* * * * *